US006578485B2

(12) United States Patent
Friedman

(10) Patent No.: US 6,578,485 B2
(45) Date of Patent: Jun. 17, 2003

(54) ARTICLE AND METHOD FOR USE IN PREPARING A LITHOGRAPHIC PRINTING PLATE BY IMAGING IN A PRINTER ENGINE

(75) Inventor: Patrick R. Friedman, Bridgewater, NJ (US)

(73) Assignee: Kodak Polychrome Graphics LLC, Norwalk, CT (US)

( * ) Notice: Subject to any disclaimer, the term of this patent is extended or adjusted under 35 U.S.C. 154(b) by 1 day.

(21) Appl. No.: 09/930,814

(22) Filed: Aug. 16, 2001

(65) Prior Publication Data

US 2003/0035923 A1 Feb. 20, 2003

(51) Int. Cl.[7] ..... B41N 1/04; B41N 1/08

(52) U.S. Cl. ..... 101/454; 101/395; 101/463.1; 428/122

(58) Field of Search ..... 101/453, 454, 101/458, 459, 463.1, 465–467, 150, 395, 401.1, 382.1, 415.1, 477; 428/122; 49/462

(56) References Cited

U.S. PATENT DOCUMENTS 3,010,394 A 11/1961 Borchers et al. ..... 101/395
3,451,169 A * 6/1969 Arnold et al. ..... 49/462
3,859,161 A * 1/1975 McLeod ..... 428/126
4,092,925 A 6/1978 Fromson ..... 101/467
4,401,503 A * 8/1983 Hertel ..... 156/461
4,833,486 A * 5/1989 Zerillo ..... 101/463.1
5,150,258 A * 9/1992 Schmidt et al. ..... 359/608
5,243,379 A 9/1993 Lein ..... 355/85
5,402,721 A * 4/1995 Schultz ..... 101/382.1
5,410,964 A * 5/1995 Koelsch ..... 101/415.1
5,470,271 A * 11/1995 Briggs et al. ..... 451/55
5,678,487 A * 10/1997 Guaraldi et al. ..... 101/477
6,375,332 B1 * 4/2002 Whinney ..... 359/838
6,390,306 B1 * 5/2002 Audet et al. ..... 211/41.1

* cited by examiner

*Primary Examiner*—Stephen R. Funk
(74) *Attorney, Agent, or Firm*—Faegre & Benson LLP

(57) ABSTRACT

A lithographic printing plate substrate is conditioned for imaging in a printer engine by an edge protector adhered along at least one edge of the plate substrate, the edge protector being of a flexible material, being coextensive with the edge, having face portions adhered to portions of the opposite faces adjacent the edge, and having an edge portion overlying the edge.

16 Claims, 1 Drawing Sheet

ARTICLE AND METHOD FOR USE IN PREPARING A LITHOGRAPHIC PRINTING PLATE BY IMAGING IN A PRINTER ENGINE

BACKGROUND OF THE INVENTION

1. Field of the Invention

The present invention relates to the imaging of lithographic plates and, more particularly, to conditioning a lithographic printing plate substrate for imaging in conventional, commercially available electrostatic or ink-jet printers.

2. Background Information

Imaging of lithographic printing plates by electrostatic or ink-jet printing has been the subject of extensive research and development and has been commercialized to some extent. In the case of electrostatic imaging, a toner is applied to an electrostatic image formed on a lithographic plate substrate and is then fused. Similarly, the desired image can be formed and then fixed on a suitably prepared substrate by ink-jetting a fluid. The toner or ink-jet image on the substrate is either receptive or repellant to a printing ink, depending on the nature of the surface of the plate substrate to which the image is applied and fixed. The substrate may or may not include a coating suitable for receiving the toner or ink jet fluid. An important advantage of electrostatic or ink-jet imaging is the current availability of machines (electrostatic copier/printers and ink-jet copier/printers) that can be readily adapted for use in imaging lithographic plate substrates.

Lithographic printing machines and processes require plates that are highly dimensionally stable and durable, which inherently makes them relatively stiff and hard. Although coated paper substrates and high-density plastic substrates are commonly used to make lithographic printing plates, metals, such as aluminum, tin and copper, are generally preferred because of their high dimensional stability and durability.

Metal plate substrates are usually prepared from metal sheet material supplied in large rolls. After any required finishing and coating treatments of the sheet material in roll form, the roll stock is slit and cut into sheets of the desired size. The slitting and cutting frequently leaves the sheets with sharp, jagged edges. Even if plate substrates are supplied to printing shops with smooth edges, some platemakers re-cut the plates, often using office-type guillotine paper cutters. Substrates cut down by printing shops (the users of the plate substrates) are virtually certain to have rough, sharp edges, burrs and other irregularities.

Many guide and sheet-transfer components of electrostatic and ink-jet printer engines are made of or coated or covered with relatively soft materials. When harder materials with sharp, rough edges are fed through the printer engines, the soft components are subject to rapid wear and in some cases immediate and costly damage. Moreover, sharp, jagged edges, burrs, and other irregularities along the edges of sheets of hard materials can lead to miss-feeding and jamming of the printer engine.

SUMMARY OF THE INVENTION

An object of the present invention is to provide an article suitable for imaging in currently available electrostatic and ink-jet printer engines to make a lithographic printing plate. More particularly, it is an object to condition a lithographic plate substrate so that it will be reliably inducted and transported by the sheet-transports of such printer engines without causing wear or damage to the printer engine. It is also an object to provide a plate substrate that is conditioned in a very simple, economical and effective way to feed properly through printer engines for imaging without miss-feeding or jamming.

As used hereinafter, the term "printer engine" means an apparatus that is capable of transporting sheet material and forming an image on the sheet material by placing a substance on the sheet material by electrostatic or ink-jet deposition.

The objects referred to above are attained, in accordance with the present invention, by an article for use in preparing a lithographic printing plate by imaging in a printer engine. The article includes a metal plate substrate in the form of a sheet having opposite faces and edges and an edge protector adhered along at least one edge of the plate substrate, the edge protector being of a flexible material, being coextensive with the edge, having face portions adhered to portions of the opposite faces adjacent the edge, and having an edge portion overlying the edge.

The edge protector ensures that the article to be imaged in a printer engine is entirely free of sharp edges that can scratch, cut, or abrade the guide and transport components of the printer engine and that can cause miss-feeding or jamming of the article in the printer engine. Edge protectors can be provided on one or all edges of plate substrates at a relatively nominal cost. Thus, even if the metal stock is slit and cut by processes that leave smooth edges, incorporating edge guards provides further assurance against problems in imaging the plate substrates in printer engines without adding significant costs. It may also be possible to reduce the costs of slitting and cutting sheets for the plates and following less rigorous quality control procedures, thereby allowing cost reductions. In instances where printing shops cut down plates substrates to meet their requirements, some embodiments of the present invention are well-suited to conditioning of the cut-down sheets by the plate makers.

One form of edge protector is a coating of a flexible resin substance. Alternatively, the edge protector may be an elongated band of flexible material folded over the edge and adhesively bonded along at least the face portions to the portions of the opposite faces adjacent the edge. A particularly simple and cost-effective form for an elongated band is a self-sticking adhesive tape. The adhesive tape, preferably, has an adhesive that is detachable from the plate substrate without marring the plate substrate, so that the edge protector can be removed from the plate after imaging. An adhesive tape having a paper base is often advantageous for use on plate substrates that are imaged in electrostatic printer engines, inasmuch as the possibility of melting or softening of the base and/or adhesive in the fuser of the printer engine is eliminated.

According to another aspect of the present invention, a method of preparing a lithographic printing plate for imaging in a printer engine includes the step of forming an edge protector along at least one edge of a plate substrate, the edge protector being of a flexible material, being coextensive with the edge, having face portions adhered to portions of the opposite faces adjacent the edge, and having an edge portion overlying the edge.

The foregoing description has outlined rather broadly some features and advantages of the present invention. The detailed description of embodiments of the invention that follows will enable the present invention to be better understood and the present contribution to the art to be more fully appreciated. Those skilled in the art will recognize that the embodiments may be readily utilized as a basis for modifying or designing other structures and methods for carrying out the purposes of the present invention. All such structures and methods are intended to be included within the spirit and scope of the invention as set forth in the appended claims.

DETAILED DESCRIPTION OF THE INVENTION

Figure 1:
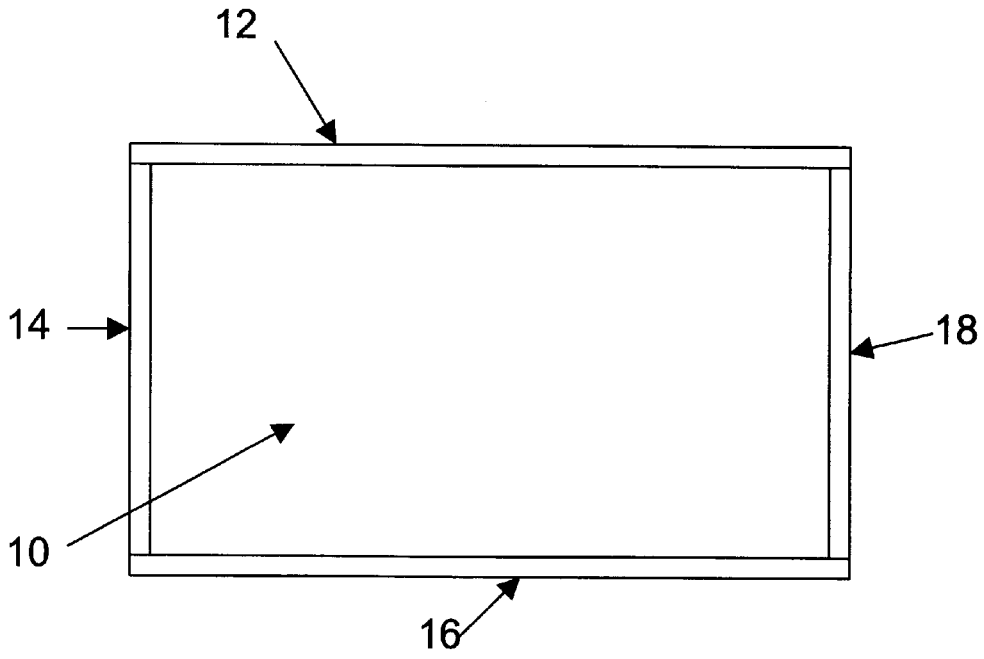
FIG. 1 is a plan view of an article according to the present invention.

In the illustrated embodiments, the reference numeral 10 designates a lithographic printing plate substrate, which may be of any suitable dimensionally stable material and prepared in any suitable manner to have a surface that accepts or rejects a lithographic printing ink and on which an image can be formed and fixed by deposition of a substance that accepts or rejects the printing ink—if the plate surface rejects the ink, the image substance accepts the ink, and vice versa. Various substrate and image configurations are suitable and well known to those skilled in the art. For example, it is possible for waterless printing to have a substrate that accepts ink and to deposit an oleophobic background material via ink jet or electrostatic processes. The present invention is particularly useful for substrates of metals, such as aluminum, tin and copper. For example, the substrate may have an aluminum sheet base, which may be of 4, 6 or 8 gauge. The substrate 10 is cut to a desired size and is rectangular.

Figure 2:
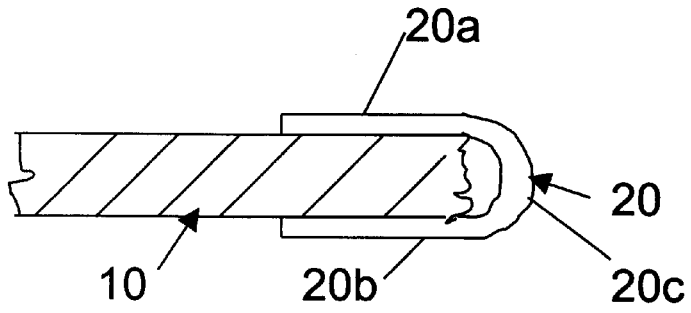
FIG. 2 is a detail, enlarged side cross-sectional view of one form edge protector applied to an edge of a plate substrate.

An edge protector 12, 14, 16, and 18 is applied to each of the four edges of the plate substrate. In one form, shown in FIG. 2, each edge protector 20 is a strip of a thin, flexible material, such as a polymeric film or paper. The strip is folded over the edge (which is shown by the ragged line to represent a jagged, cut edge) so that face portions 20*a* and 20*b* of the edge protector 20 overlie bands of the opposite surfaces of the plate substrate 10 along the edge and an edge portion 20*c* overlies the edge of the plate substrate. The face portions 20*a* and 20*b* are bonded to the surfaces of the plate substrate 10 by an adhesive. An especially suitable edge protector of the strip type shown in FIG. 2 is a tape pre-coated with a self-sticking adhesive. Paper-based adhesive tapes are useful in articles according to the invention for imaging in electrostatic printing engines, inasmuch as they can endure heating in the flier. Suitable paper-based adhesive tapes are supplied by American Tape located at 317 Kendall Avenue, Marsville, Mich.

Figure 3:
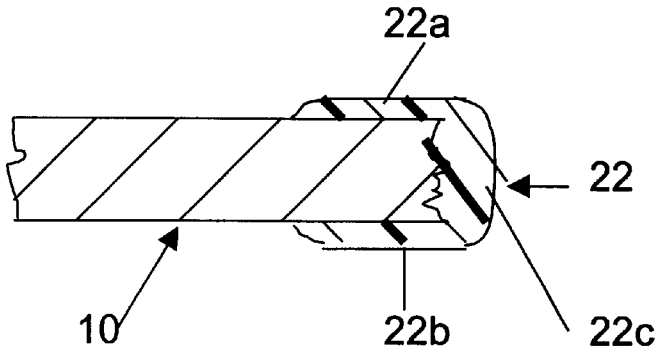
FIG. 3 is a detail, enlarged side cross-sectional view of another form edge protector applied to an edge of a plate substrate.

Another suitable form (see FIG. 3) of edge protector for articles according to the present invention is provided by an edge-coating 22 of a flexible resin material. Suitable resins for the edge guard application can be polyvinyl alcohol and its derivatives, polyvinyl ethers, cellulose derivatives such as HEC, HMC & CMC, soluble alkyd resins, polyethylene oxides, polyvinyl pyrrolidone, polyacrylic acids and the associated salts, sodium alginate, pluran, soluble nylon like polyamides, maleic acid copolymers, and water soluble natural gums like gum arabic. The resin edge coating may be applied by dipping, brush-coating, or roller-coating, for example. As in the case of the strip type protectors of FIG. 2, the edge-coating 22 has face portions 22*a* and 22*b* that overlie bands of the opposite surfaces of the plate substrate 10 along the edge and an edge portion 22*c* that overlies the edge of the plate substrate. The face portions 20*a* and 20*b* adhere to the surfaces of the plate substrate 10. The edge portion 22*c* adheres to the jagged edge of the plate substrate. The bond of the edge portion 22*c* to the edge of the plate is enhanced by the roughness of the edge of the plate and the fact that the edge-coating directly and intimately contacts the edge of the plate, as shown in FIG. 3.

Various aspects of the particular applications of the present invention are subject to routine experimentation with specific printer engines. For example, the materials of the adhesive, the strip that forms the protector, and the edge-coating resin, as the case may be, should be selected in advance with attention to the effects of heat in the case of electrostatic printers. Generally, each edge protector should be coextensive with the edge of the substrate to which it is applied but should usually not overlap an adjacent protector so as to avoid double thicknesses of face portions at the corners. It may be, however, that some printer engines will work perfectly well with double thickness face portions at the corners, depending on the specific design of the guide and feed components. The tenacity of the bond of the edge protectors to the plate substrates generally need only be sufficient to ensure retention upon induction into and transport of the plate substrate through the printer engine without detachment of protectors. Low tenacity is desirable, so that the edge protectors can, if desirable or necessary, be removed before the finished plate is used for lithographic printing.

The invention claimed is:

1. An article for use in preparing a lithographic printing plate by imaging in a printer engine, comprising a plate substrate of dimensionally stable material in the form of a sheet having opposite faces and edges, and an edge protector adhered along at least one edge of the plate substrate, the edge protector being of a flexible material, being coextensive with the edge, having face portions adhered to portions of the opposite faces adjacent the edge, and having an edge portion overlying the edge.

2. The article according to claim 1, wherein the plate substrate is a metal sheet.

3. The article according to claim 2, wherein the edge protector is an edge coating of a flexible resin substance.

4. The article according to claim 2, wherein the edge protector is an elongated band of thin flexible material folded over the edge and adhesively bonded along at least the face portions to the portions of the opposite faces adjacent the edge.

5. The article according to claim 4, wherein the elongated band of flexible material is a self-sticking adhesive tape.

6. The article according to claim 5, wherein the adhesive tape has an adhesive that is detachable from the plate substrate without marring the plate substrate.

7. The article according to claim 5, wherein the adhesive tape has a paper base.

8. The article according to claim 7, wherein the adhesive tape has an adhesive that is detachable from the plate substrate without marring the plate substrate.

9. A method of preparing a lithographic printing plate for imaging in a printer engine, comprising:

providing a plate substrate of dimensionally stable material in the form of a sheet having opposite faces and edges; and forming an edge protector along at least one edge of the plate substrate, the edge protector being of a flexible material, being coextensive with the edge, having face portions adhered to portions of the opposite faces adjacent the edge, and having an edge portion overlying the edge.

10. The method according to claim 9, wherein the plate substrate is a metal sheet.

11. The method according to claim 10, wherein the edge protector is an edge coating of a flexible resin substance.

12. The method according to claim 10, wherein the edge protector is an elongated band of flexible material folded over the edge and adhesively bonded along at least the face portions to the portions of the opposite faces adjacent the edge.

13. The method according to claim 12, wherein the elongated band of flexible material is a self-sticking adhesive tape.

14. The method according to claim 13, wherein the adhesive tape has an adhesive that is detachable from the plate substrate without marring the plate substrate.

15. The method according to claim 13, wherein the adhesive tape has a paper base.

16. The method according to claim 15, wherein the adhesive tape has an adhesive that is detachable from the plate substrate without marring the plate substrate.

* * * * *